US005996461A

United States Patent [19]

Croft

[11] Patent Number: 5,996,461

[45] Date of Patent: Dec. 7, 1999

[54] ASPHALT SHINGLE SHEET CUTTING DEVICE

[76] Inventor: Owen W. Croft, 5927 Greenwood Dr., Murray, Utah 84123

[21] Appl. No.: 09/164,637

[22] Filed: Oct. 1, 1998

[51] Int. Cl.[6] ..... B26D 3/02

[52] U.S. Cl. ..... 83/581; 83/605; 83/920

[58] Field of Search ..... 83/605, 607, 608, 83/581, 471.3, 468, 522.19, 920

[56] References Cited

U.S. PATENT DOCUMENTS

| | | | |
|---|---|---|---|
| 1,830,284 | 11/1931 | Massa | 83/608 |
| 2,254,374 | 9/1941 | Laukhuff | 83/607 |
| 2,573,767 | 11/1951 | Jensen et al. | 83/605 |
| 3,735,445 | 5/1973 | Jurcak | 83/607 |
| 4,011,782 | 3/1977 | Clark et al. | 83/581 |
| 4,567,802 | 2/1986 | Witherspoon | 83/607 |
| 4,638,700 | 1/1987 | Fushiya et al. | 83/581 |
| 5,052,256 | 10/1991 | Morrissey | 83/607 |
| 5,105,862 | 4/1992 | Skinner et al. | 83/471.3 |
| 5,829,333 | 11/1998 | Itzov | 83/581 |

FOREIGN PATENT DOCUMENTS

| | | | |
|---|---|---|---|
| 157740 | 7/1954 | Sweden | 83/608 |

*Primary Examiner*—Rinaldi I. Rada
*Assistant Examiner*—Omar Flores-Sanchez

[57] ABSTRACT

An asphalt shingle sheet cutting device for quickly cutting an asphalt shingle sheet along a straight line at a variety of angles. The device includes a lower base platform and an upper cutting platform coupled to base platform by a plurality of downwardly depending support legs. An adjustment plate is coupled to the lower surface of the cutting platform. The adjustment plate has a pivot pin downwardly depending therefrom. A swing arm is pivotally mounted to the pivot pin of the adjustment plate. The swing arm has a mounting shaft upwardly extending from the rearwards end of the swing arm. A cutting blade is pivotally coupled to the upper end of the mounting shaft. The front edge of the adjustment plate has a plurality of spaced apart notches for contacting an abutment tab extending from the swing arm to hold the mounting shaft and the cutting blade at predetermined angles.

10 Claims, 2 Drawing Sheets

ASPHALT SHINGLE SHEET CUTTING DEVICE

BACKGROUND OF THE INVENTION

1. Field of the Invention

The present invention relates to shingle cutting devices and more particularly pertains to a new asphalt shingle sheet cutting device for quickly cutting an asphalt shingle sheet such as a three tab shingle sheet along a straight line at a variety of angles.

2. Description of the Prior Art

The use of shingle cutting devices is known in the prior art. More specifically, shingle cutting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,392,677; U.S. Pat. No. 5,249,495; U.S. Pat. No. 5,052,256; U.S. Pat. No. 4,821,609; U.S. Pat. No. Des. 319,840; and U.S. Pat. No. 5,165,314.

While these devices fulfill their respective, particular objectives and requirements, the aforementioned patents do not disclose a new asphalt shingle sheet cutting device. The inventive device includes a lower base platform and an upper cutting platform coupled to base platform by a plurality of downwardly depending support legs. An adjustment plate is coupled to the lower surface of the cutting platform. The adjustment plate has a pivot pin downwardly depending therefrom. A swing arm is pivotally mounted to the pivot pin of the adjustment plate. The swing arm has a mounting shaft upwardly extending from the rearwards end of the swing arm. A cutting blade is pivotally coupled to the upper end of the mounting shaft. The front edge of the adjustment plate has a plurality of spaced apart notches for contacting an abutment tab extending from the swing arm to hold the mounting shaft and the cutting blade at predetermined angles.

In these respects, the asphalt shingle sheet cutting device according to the present invention substantially departs from the conventional concepts and designs of the prior art, and in so doing provides an apparatus primarily developed for the purpose of quickly cutting an asphalt shingle sheet along a straight line at a variety of angles.

SUMMARY OF THE INVENTION

In view of the foregoing disadvantages inherent in the known types of shingle cutting devices now present in the prior art, the present invention provides a new asphalt shingle sheet cutting device construction wherein the same can be utilized for quickly cutting an asphalt shingle sheet along a straight line at a variety of angles.

The general purpose of the present invention, which will be described subsequently in greater detail, is to provide a new asphalt shingle sheet cutting device apparatus and method which has many of the advantages of the shingle cutting devices mentioned heretofore and many novel features that result in a new asphalt shingle sheet cutting device which is not anticipated, rendered obvious, suggested, or even implied by any of the prior art shingle cutting devices, either alone or in any combination thereof.

To attain this, the present invention generally comprises a lower base platform and an upper cutting platform coupled to base platform by a plurality of downwardly depending support legs. An adjustment plate is coupled to the lower surface of the cutting platform. The adjustment plate has a pivot pin downwardly depending therefrom. A swing arm is pivotally mounted to the pivot pin of the adjustment plate. The swing arm has a mounting shaft upwardly extending from the rearwards end of the swing arm. A cutting blade is pivotally coupled to the upper end of the mounting shaft. The front edge of the adjustment plate has a plurality of spaced apart notches for contacting an abutment tab extending from the swing arm to hold the mounting shaft and the cutting blade at predetermined angles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new asphalt shingle sheet cutting device apparatus and method which has many of the advantages of the shingle cutting devices mentioned heretofore and many novel features that result in a new asphalt shingle sheet cutting device which is not anticipated, rendered obvious, suggested, or even implied by any of the prior art shingle cutting devices, either alone or in any combination thereof.

It is another object of the present invention to provide a new asphalt shingle sheet cutting device which may be easily and efficiently manufactured and marketed.

It is a further object of the present invention to provide a new asphalt shingle sheet cutting device which is of a durable and reliable construction.

An even further object of the present invention is to provide a new asphalt shingle sheet cutting device which is susceptible of a low cost of manufacture with regard to both materials and labor, and which accordingly is then susceptible of low prices of sale to the consuming public, thereby making such asphalt shingle sheet cutting device economically available to the buying public.

Still yet another object of the present invention is to provide a new asphalt shingle sheet cutting device which provides in the apparatuses and methods of the prior art some of the advantages thereof, while simultaneously overcoming some of the disadvantages normally associated therewith.

Still another object of the present invention is to provide a new asphalt shingle sheet cutting device for quickly cutting an asphalt shingle sheet along a straight line at a variety of angles.

Yet another object of the present invention is to provide a new asphalt shingle sheet cutting device which includes a lower base platform and an upper cutting platform coupled to base platform by a plurality of downwardly depending support legs. An adjustment plate is coupled to the lower surface of the cutting platform. The adjustment plate has a pivot pin downwardly depending therefrom. A swing arm is pivotally mounted to the pivot pin of the adjustment plate. The swing arm has a mounting shaft upwardly extending from the rearwards end of the swing arm. A cutting blade is pivotally coupled to the upper end of the mounting shaft. The front edge of the adjustment plate has a plurality of spaced apart notches for contacting an abutment tab extending from the swing arm to hold the mounting shaft and the cutting blade at predetermined angles.

Still yet another object of the present invention is to provide a new asphalt shingle sheet cutting device that is portable to a job site to reduce the time taken to cut shingle sheets.

Even still another object of the present invention is to provide a new asphalt shingle sheet cutting device that cuts straight edges rather than leaving a jagged edge which can frequently happen when a shingle sheet is cut with a utility knife.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
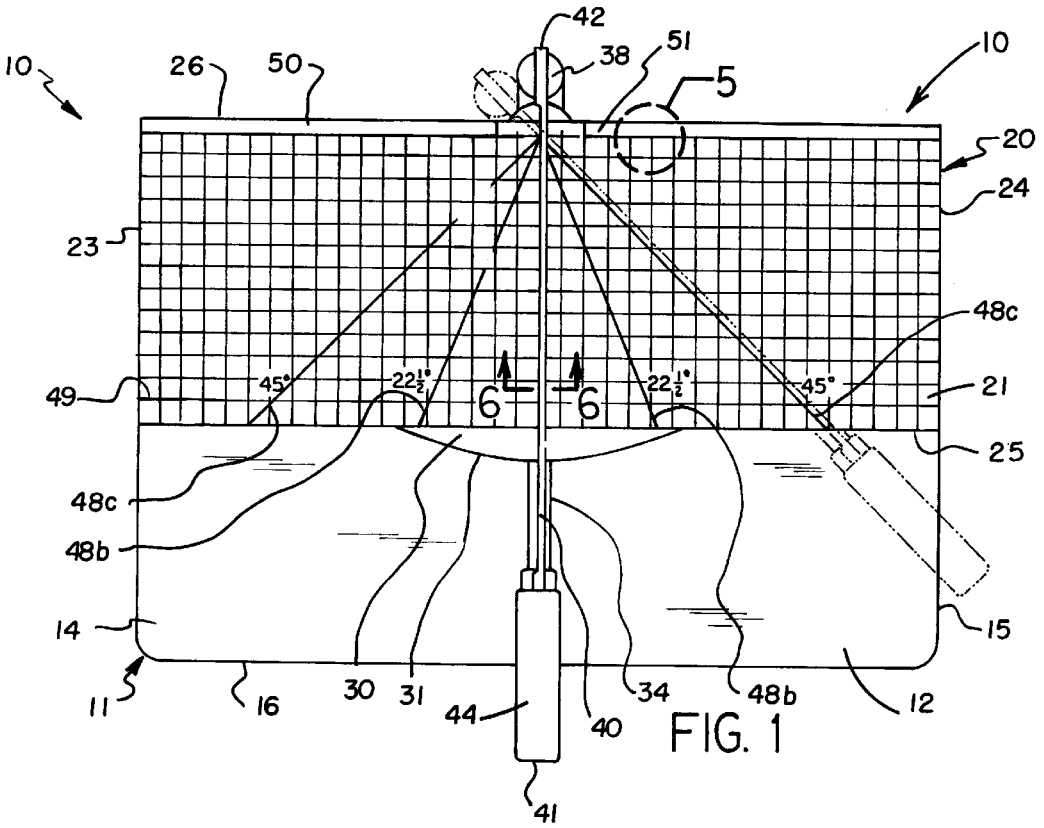
FIG. 1 is a schematic top plan view of a new asphalt shingle sheet cutting device according to the present invention.
Figure 2:
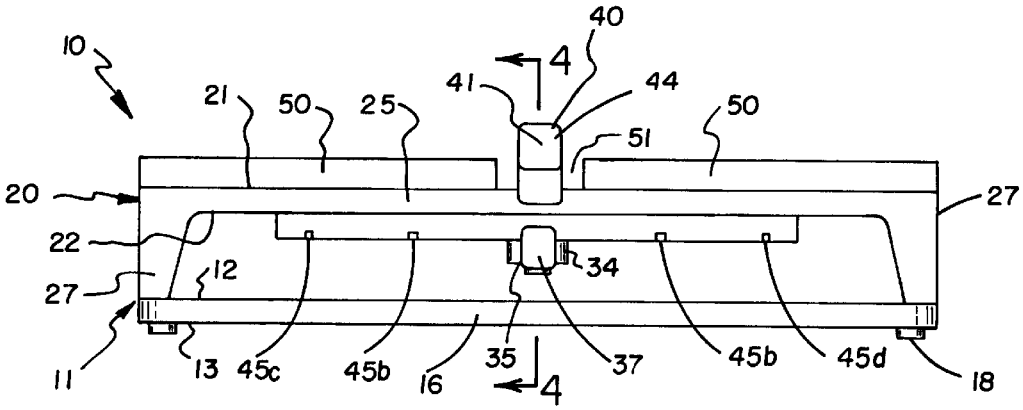
FIG. 2 is a schematic front plan view of the present invention.
Figure 3:
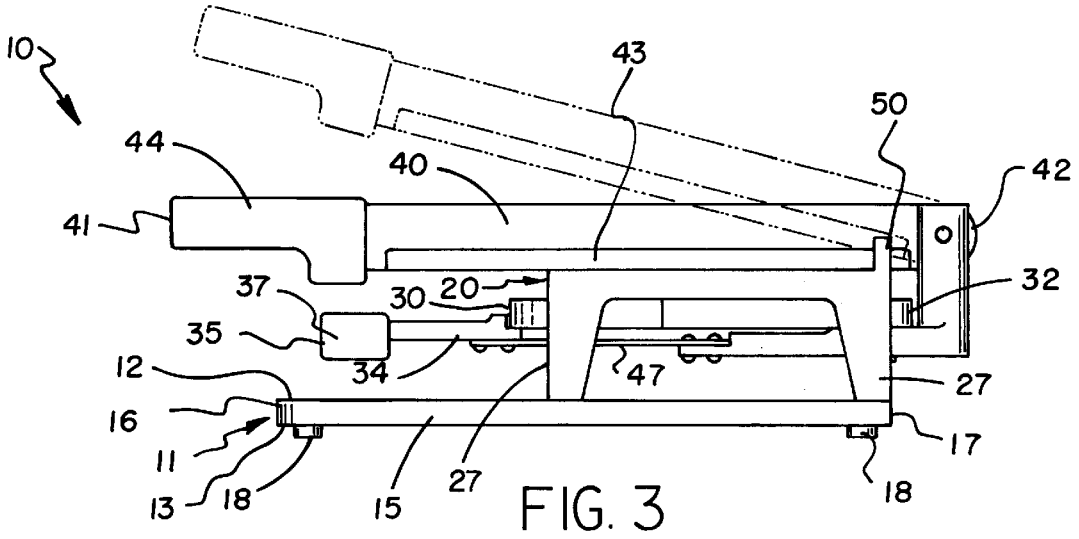
FIG. 3 is a schematic side plan view of the present invention.
Figure 4:
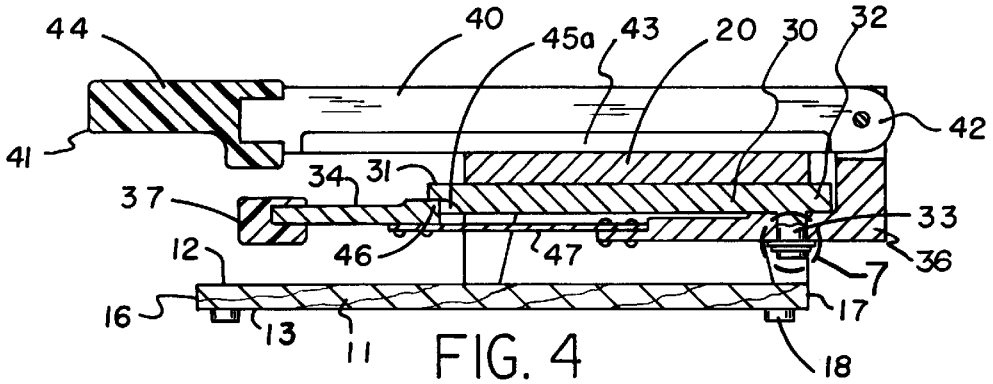
FIG. 4 is a schematic cross sectional view of the present invention taken from line 4—4 of FIG. 2.
Figure 5:
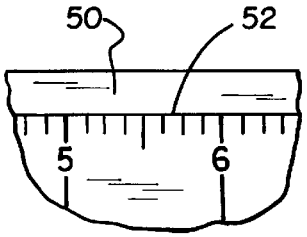
FIG. 5 is a schematic partial plan view of the present invention taken from the circle 5 on FIG. 1.
Figure 6:
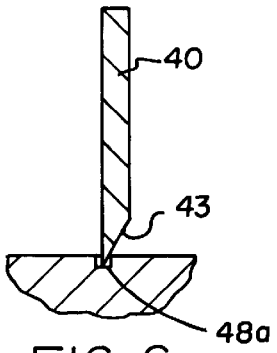
FIG. 6 is a schematic cross sectional view of the present invention taken from line 6—6 on FIG. 1.
Figure 7:
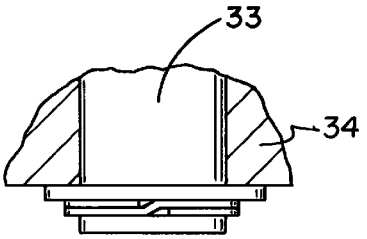
FIG. 7 is a schematic partial cross sectional view of the present invention taken from the circle 7 on FIG. 4.

With reference now to the drawings, and in particular to FIGS. 1 through 7 thereof, a new asphalt shingle sheet cutting device embodying the principles and concepts of the present invention and generally designated by the reference numeral 10 will be described.

As best illustrated in FIGS. 1 through 7, the asphalt shingle sheet cutting device 10 generally comprises a lower base platform 11 and an upper cutting platform 20 coupled to base platform 11 by a plurality of downwardly depending support legs 27. An adjustment plate 30 is coupled to the lower surface 22 of the cutting platform 20. The adjustment plate 30 has a pivot pin 33 downwardly depending therefrom. A swing arm 34 is pivotally mounted to the pivot pin 33 of the adjustment plate 30. The swing arm 34 has a mounting shaft 38 upwardly extending from the rearwards end 36 of the swing arm 34. A cutting blade 40 is pivotally coupled to the upper end of the mounting shaft 38. The front edge 31 of the adjustment plate 30 has a plurality of spaced apart notches 45*a*,45*b*,45*c* for contacting an abutment tab 46 extending from the swing arm 34 to hold the mounting shaft 38 and the cutting blade 40 at predetermined angles.

In use the device 10 is designed for cutting a shingle sheet, in particular, a three tab asphalt shingle sheet in a straight line generally perpendicular to one of the sides of the shingle or to a predetermined angle with respect to that side so that the shingle may be fitted along the contours of a roof structure.

In closer detail, the a base platform 11 is generally rectangular and has generally planar top and bottom faces 12,13, and an outer perimeter comprising a pair of generally straight end edges 14,15, generally straight proximal and distal side edges 16,17 extending between the end edges 14,15 of the base platform 11, and a four of corner edges. The base platform 11 has a thickness defined between the top and bottom faces 12,13 of the base platform 11, a length defined between the end edges 14,15 of the base platform 11, and a width defined between the proximal and distal side edges 16,17 of the base platform 11.

Preferably, the bottom face 13 of the base platform 11 has a plurality of resting feet 18 downwardly depending therefrom. The resting feet 18 are designed for resting on a resting surface such as, for example, a table top, the top of a workbench or a ground surface. A resting foot is located adjacent each of the corner edges of the base platform 11. The resting feet 18 comprise a resiliently deformable rubber material to prevent sliding of the resting feet 18 on the resting surface.

The cutting platform 20 is generally rectangular and has generally planar upper and lower surfaces 21,22, and an outer perimeter comprising a pair of generally straight ends 23,24, generally straight front and back sides 25,26 extending between the end edges 14,15 of the cutting platform 20, and a four of corners. The upper surface 21 of the cutting platform 20 is designed for resting an asphalt shingle sheet thereon to be cut. The cutting platform 20 has a thickness defined between the upper and lower faces of the cutting platform 20, a length defined between the ends 23,24 of the cutting platform 20, and a width defined between the front and back sides 25,26 of the cutting platform 20.

The lower surface 22 of the cutting platform 20 has a plurality of support legs 27 downwardly depending therefrom. Each of the support legs 27 of the cutting platform 20 is positioned adjacent a corner of the cutting platform 20. The support legs 27 of the cutting platform 20 are coupled to the top face 12 of the base platform 11 such that the cutting platform 20 is spaced above the base platform 11. Preferably, the base platform 11 and the cutting platform 20 lie in generally parallel planes to one another.

The back side 26 of the cutting platform 20 and the distal side edge 17 of the base platform 11 are generally aligned with each other such that the back side 26 of the cutting platform 20 and the distal side edge 17 of the base platform 11 generally lie in a plane extending generally perpendicular to the generally parallel planes of the base platform 11 and the cutting platform 20. The width of the cutting platform 20 is less than the width of the base platform 11 such that the front side 31 of the cutting platform 20 is located between the proximal and distal side edges 16,17 of the base platform 11. Preferably, the width of the cutting platform 20 is between about one-fourth the width of the base platform 11 and about three-fourths the width of the base platform 11. Ideally, the width of the base platform 11 is slightly more than about one-half the width of the base platform 11.

The adjustment plate 30 is coupled to the lower surface 22 of the cutting platform 20. The adjustment plate 30 has front and back edges 31,32. The front edge 31 of the adjustment plate 30 is generally arcuate and extends in a direction outwardly from the front side 31 of the cutting platform 20. The back edge 32 of the adjustment plate 30 is positioned adjacent the back side 26 of the cutting edge 43. The adjustment plate 30 has a pivot pin 33 downwardly depending therefrom towards the base platform 11. The pivot pin 33 extends generally perpendicular to the cutting platform 20 and is located towards the back end of the adjustment plate 30.

The swing arm 34 has forwards and rearwards ends 35,36. The swing arm 34 is pivotally mounted to the pivot pin 33 of the adjustment plate 30 to permit swiveling of the swing arm 34 on the pivot pin 33 in a plane generally parallel to the parallel planes of the cutting platform 20 and the base platform 11. The forwards end 35 of the swing arm 34 is outwardly extended in a direction from the front edge 31 of the adjustment plate 30 towards the proximal side edge 16 of the base platform 11. Preferably, the forwards end 35 of the swing arm 34 terminates at a gripping knob 37 designed for grasping by the hand of a user for pivoting the swing arm 34 on the pivot pin 33 between the ends of the cutting plate. The rearwards end 36 of the swing arm 34 is outwardly extended in a direction away from the back side 26 of the cutting platform 20. The swing arm 34 has a mounting shaft 38 upwardly extending from the rearwards end 36 of the swing arm 34. The mounting shaft 38 has an upper end extending above a plane of the upper surface 21 of the cutting platform 20.

The cutting blade 40 has opposite proximal and distal ends 41,42, and a lower sharpened cutting edge 43 designed for cutting asphalt shingle sheets extending between the proximal and distal ends 41,42 of the cutting blade 40. The distal end 42 of the cutting blade 40 is pivotally coupled to the upper end of the mounting shaft 38 to permit pivoting of the cutting blade 40 about an axis generally parallel to the plane of the upper surface 21 of the cutting platform 20. In use, the cutting blade 40 is pivotable to a position where the lower sharpened cutting edge 43 of the cutting plane lies generally parallel on the upper surface 21 of the cutting platform 20 to permit cutting by the cutting blade 40 of a shingle sheet rested on the upper surface 21 of the cutting platform 20. The proximal end 41 of the cutting blade 40 has a handle 44 for gripping by the hand of a user to permit pivoting up and down of the cutting blade 40 by the user.

The front edge 31 of the adjustment plate 30 has a plurality of spaced apart notches 45*a*,45*b*,45*c* for contacting an abutment tab 46 extending from the swing arm 34 to hold the mounting shaft 38 and the cutting blade 40 at predetermined angles defined from the pivot pin 33. Ideally, the predetermined angles comprise 0 degrees (for notch 45*a*), 22.5 degrees (for notches 45*b*), and 45 degrees (for notches 45*c* ). The swing arm 34 preferably has a resiliently deflectable portion 47 (such as a spring metal portion) adjacent the abutment of the swing arm 34 to permit deflection of the swing arm 34 to remove and insert the abutment in the notches 45*a*,45*b*,45*c* of the adjustment plate 30.

The upper surface 21 of the cutting platform 20 has a plurality of generally straight elongate grooves 48*a*,48*b*,48*c* therein extending between the front and back sides 25,26 of the cutting platform 20. The grooves 48*a*,48*b*,48*c* of the cutting platform 20 extend at the predetermined angles that is 0 degrees (for groove 48*a*), 22.5 degrees (for grooves 48*b*), and 45 degrees (for grooves 48*c* ). The 0 degree groove 48*a* extends generally perpendicular to the front and back sides 25,26 of the cutting platform 20. Preferably, the upper surface 21 of the cutting platform 20 has indicia adjacent each groove indicating the predetermined angle of the particular groove as illustrated in FIG. 1. In use, the grooves are designed for receiving the lower sharpened cutting edge 43 of the cutting blade 40 therein for cutting a shingle resting on the upper surface 21 of the cutting platform 20 at the predetermined angle.

The upper surface 21 of the cutting platform 20 also preferably has a guide grid 49 thereon for aiding the proper positioning of shingles on the upper surface 21 of the cutting platform 20. The guide grid 49 comprises a plurality of spaced apart parallel row lines and a plurality of spaced apart parallel column lines defining a plurality of squares. The row lines extend generally parallel to the front and back sides 25,26 of the cutting platform 20. The column lines extend generally parallel to the ends 23,24 of the cutting platform 20 and generally perpendicular to the row lines. The row lines are ideally spaced apart from each other at generally equal intervals of about $1/8^{th}$ inch and the column lines are ideally spaced apart from each other at generally equal intervals of about $1/8^{th}$ inch.

The back side 26 of the cutting platform 20 has an upwardly extending elongate guide wall 50 extending between the ends 23,24 of the cutting platform 20. The guide wall 50 is generally perpendicular to the upper surface 21 of the cutting platform 20. The guide wall 50 has a break 51 therein for permitting extension therethrough and pivoting therein of the cutting blade 40. The upper surface 21 of the cutting platform 20 has a ruler 52 thereon adjacent the guide wall 50 and extending between the ends 23,24 of the cutting platform 20 for permitting measuring of shingles on the cutting platform 20.

In use, a shingle is placed on the upper surface of the cutting platform. The swing arm is pivoted to pivot the cutting blade to the desired angle and the cutting blade is then pivoted downwards to cut the shingle on the upper surface of the cutting platform at the desired angle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for cutting a shingle, said device comprising:

a base platform having top and bottom faces, and an outer perimeter comprising a pair of end edges, proximal and distal side edges extending between said end edges of said base platform, and a plurality of corner edges;

a cutting platform having upper and lower surface, and an outer perimeter comprising a pair of ends, generally front and back sides extending between said ends of said cutting platform, and a plurality of corners;

said lower surface of said cutting platform having a plurality of support legs downwardly depending therefrom;

said support legs of said cutting platform being coupled to said top face of said base platform such that said cutting platform is spaced above said base platform;

an adjustment plate being coupled to said lower surface of said cutting platform, said adjustment plate having front and back edges;

said adjustment plate having a pivot pin downwardly depending therefrom;

a swing arm having forwards and rearwards ends, said swing arm being pivotally mounted to said pivot pin of said adjustment plate;

said swing arm having a mounting shaft upwardly extending from said rearwards end of said swing arm, said mounting shaft having an upper end;

a cutting blade having opposite proximal and distal ends, and a lower sharpened cutting edge extending between said proximal and distal ends of said cutting blade;

said distal end of said cutting blade being pivotally coupled to said upper end of said mounting shaft; and said front edge of said adjustment plate having a plurality of spaced apart notches for contacting an abutment tab extending from said swing arm to hold said mounting shaft and said cutting blade at predetermined angles.

2. The device of claim 1, wherein said base platform has a width defined between said proximal and distal side edges of said base platform, wherein said cutting platform has a width defined between said front and back sides of said cutting platform, said width of said cutting platform being less than said width of said base platform.

3. The device of claim 2, wherein said width of said cutting platform is between about one-fourth said width of said base platform and about three-fourths said width of said base platform.

4. The device of claim 1, wherein said bottom face of said base platform having a plurality of resting feet downwardly depending therefrom, a resting foot being located adjacent each of said corner edges of said base platform, said resting feet comprising a resiliently deformable material to prevent sliding of said resting feet on a resting surface.

5. The device of claim 1, wherein said base platform and said cutting platform lie in generally parallel planes to one another.

6. The device of claim 1, wherein said predetermined angles comprise 0 degrees, 22.5 degrees, and 45 degrees.

7. The device of claim 1, wherein said swing arm has a resiliently deflectable portion adjacent said abutment of said swing arm.

8. The device of claim 1, wherein said upper surface of said cutting platform has a plurality of generally straight elongate grooves therein extending between said front and back sides of said cutting platform, said grooves of said cutting platform extending at said predetermined angles and being adapted for receiving said lower sharpened cutting edge of said cutting blade therein for cutting a shingle resting on said upper surface of said cutting platform at the predetermined angle.

9. The device of claim 1, wherein said upper surface of said cutting platform has a guide grid thereon for aiding the proper positioning of shingles on said upper surface of said cutting platform, said guide grid comprising a plurality of spaced apart parallel row lines and a plurality of spaced apart parallel column lines defining a plurality of squares, said row lines extending generally parallel to said front and back sides of said cutting platform, said column lines extending generally parallel to said ends of said cutting platform and generally perpendicular to said row lines, said row lines being spaced apart from each other at generally equal intervals of about $1/8^{th}$ inch, said column lines being spaced apart from each other at generally equal intervals of about $1/8^{th}$ inch.

10. A device for cutting a shingle, said device comprising:

a base platform being generally rectangular and having generally planar top and bottom faces, and an outer perimeter comprising a pair of generally straight end edges, generally straight proximal and distal side edges extending between said end edges of said base platform, and a plurality of corner edges;

said base platform having a thickness defined between said top and bottom faces of said base platform, a length defined between said end edges of said base platform, and a width defined between said proximal and distal side edges of said base platform;

said bottom face of said base platform having a plurality of resting feet downwardly depending therefrom, a resting foot being located adjacent each of said corner edges of said base platform, said resting feet comprising a resiliently deformable material;

a cutting platform being generally rectangular and having generally planar upper and lower surface, and an outer perimeter comprising a pair of generally straight ends, generally straight front and back side extending between said end edges of said cutting platform, and a plurality of corners;

said cutting platform having a thickness defined between said upper and lower faces of said cutting platform, a length defined between said ends of said cutting platform, and a width defined between said front and back sides of said cutting platform;

said lower surface of said cutting platform having a plurality of support legs downwardly depending therefrom, each of said support legs of said cutting platform being positioned adjacent a corner of said cutting platform;

said support legs of said cutting platform being coupled to said top face of said base platform such that said cutting platform is spaced above said base platform;

said base platform and said cutting platform lying in generally parallel planes to one another;

said back side of said cutting platform and said distal side edge of said base platform being generally aligned with each other such that said back side of said cutting platform and said distal side edge of said base platform generally lie in a plane extending generally perpendicular to the planes of said base platform and said cutting platform;

said width of said cutting platform being less than said width of said base platform such that said front side of said cutting platform is located between said proximal and distal side edges of said base platform, wherein said width of said cutting platform is between about one-fourth said width of said base platform and about three-fourths said width of said base platform;

an adjustment plate being coupled to said lower surface of said cutting platform, said adjustment plate having front and back edges;

said front edge of said adjustment plated being generally arcuate and extending outwardly from said front side of said cutting platform;

said back edge of said adjustment plate being positioned adjacent said back side of said cutting edge;

said adjustment plate having a pivot pin downwardly depending therefrom towards said base platform, said pivot pin extending generally perpendicular to said cutting platform, said pivot pin of said adjustment plate being located towards said back end of said adjustment plate;

a swing arm having forwards and rearwards ends, said swing arm being pivotally mounted to said pivot pin of said adjustment plate;

said forwards end of said swing arm being outwardly extended in a direction from said front edge of said adjustment plate towards said proximal side edge of said base platform;

said forwards end of said swing arm terminating at a gripping knob;

said rearwards end of said swing arm being outwardly extended in a direction away from said back side of said cutting platform;

said swing arm having a mounting shaft upwardly extending from said rearwards end of said swing arm, said mounting shaft having an upper end extending above a plane of said upper surface of said cutting platform;

a cutting blade having opposite proximal and distal ends, and a lower sharpened cutting edge extending between said proximal and distal ends of said cutting blade;

said distal end of said cutting blade being pivotally coupled to said upper end of said mounting shaft to permit pivoting of said cutting blade about an axis generally parallel to said plane of said upper surface of said cutting platform;

said cutting blade being pivotable to a position where said lower sharpened cutting edge of said cutting plane lies generally parallel on said upper surface of said cutting platform;

said proximal end of said cutting blade having a handle;

said front edge of said adjustment plate having a plurality of spaced apart notches for contacting an abutment tab extending from said swing arm to hold said mounting shaft and said cutting blade at predetermined angles, wherein said predetermined angles comprise 0 degrees, 22.5 degrees, and 45 degrees;

said swing arm having a resiliently deflectable portion adjacent said abutment of said swing arm;

said upper surface of said cutting platform having a plurality of generally straight elongate grooves therein extending between said front and back sides of said cutting platform, said grooves of said cutting platform extending at said predetermined angles and being adapted for receiving said lower sharpened cutting edge of said cutting blade therein for cutting a shingle resting on said upper surface of said cutting platform at the predetermined angle;

said upper surface of said cutting platform having a guide grid thereon for aiding the proper positioning of shingles on said upper surface of said cutting platform, said guide grid comprising a plurality of spaced apart parallel row lines and a plurality of spaced apart parallel column lines defining a plurality of squares;

said row lines extending generally parallel to said front and back sides of said cutting platform, said column lines extending generally parallel to said ends of said cutting platform and generally perpendicular to said row lines;

said row lines being spaced apart from each other at generally equal intervals of about $1/8^{th}$ inch, said column lines being spaced apart from each other at generally equal intervals of about $1/8^{th}$ inch;

said back side of said cutting platform having an upwardly extending elongate guide wall extending between said ends of said cutting platform, said guide wall being generally perpendicular to said upper surface of said cutting platform, said guide wall having a break therein for permitting extension therethrough and pivoting therein of said cutting blade; and said upper surface of said cutting platform having a ruler thereon adjacent said guide wall and extending between said ends of said cutting platform.

* * * * *